United States Patent [19]

Fontecchio et al.

[11] Patent Number: 4,728,916

[45] Date of Patent: Mar. 1, 1988

[54] SOLENOID OPERATED FLUID CONTROL VALVE

[75] Inventors: Robert P. Fontecchio, Rochester; Michael Slavin, Troy; David B. Smith, Lapeer, all of Mich.

[73] Assignee: Lectron Products, Inc., Rochester Hills, Mich.

[21] Appl. No.: 870,978

[22] Filed: Jun. 5, 1986

[51] Int. Cl.[4] ..... H01F 7/08

[52] U.S. Cl. ..... 335/255; 335/278; 336/192

[58] Field of Search ..... 335/255, 260, 262, 278; 336/192, 198

[56] References Cited

U.S. PATENT DOCUMENTS

| | | | |
|---|---|---|---|
| 3,331,042 | 7/1967 | Erickson et al. | 335/262 X |
| 3,348,178 | 10/1967 | Erickson et al. | 335/262 X |
| 3,605,054 | 9/1971 | Conrath | 335/260 X |
| 4,003,128 | 1/1977 | Dochterman . | |
| 4,099,316 | 7/1978 | Morgan et al. . | |
| 4,166,262 | 8/1979 | Jencks et al. | 335/262 X |
| 4,166,265 | 8/1979 | Reynolds et al. | 336/192 |
| 4,229,722 | 10/1980 | Olsen | 336/192 |
| 4,251,911 | 2/1981 | Reynolds et al. . | |
| 4,318,069 | 3/1982 | Morse | 336/192 |

OTHER PUBLICATIONS

Lectron Drawing No. 8005-6, Showing a Valve Manufactured by Applicant for 1985 Model Year Domestic Motor Vehicles.

*Primary Examiner*—George Harris

*Attorney, Agent, or Firm*—Harness, Dickey & Pierce

[57] ABSTRACT

This invention relates to an improved solenoid operated fluid control valve particularly adapted for use as a vacuum control switch in a motor vehicle. One aspect of this invention is the provision of a coil assembly adapted to be wound and terminated using completely automated processes. This feature is provided through the use of a bobbin structure having protruding coil winding posts which position the start and finish ends of the coil wire. Terminal members are installed onto the bobbin and have terminal contact portions which can be folded onto the wire. Another feature of this invention involves means for reducing noise generated from actuation of the valve device. In conventional solenoid employing a "C" frame member, direct mechanical contact exists between the "C" frame member and another component of the magnetic circuit of the solenoid. In accordance with this invention, a thin annular layer of encapsulation material is provided between bores of the "C" frame member and the associated components of the magnetic circuit. This layer of encapsulation material prevents direct mechanical coupling with the "C" frame component, thus reducing noise generation. Means for calibrating the valve assembly according to this invention are also provided comprising driving a pole piece member into the coil bobbin bore as electrical and fluid control signals are applied. The pole piece motion is stopped once a change in state of the valve is observed, whereupon the desired physical parameters of the valve are provided.

23 Claims, 14 Drawing Figures

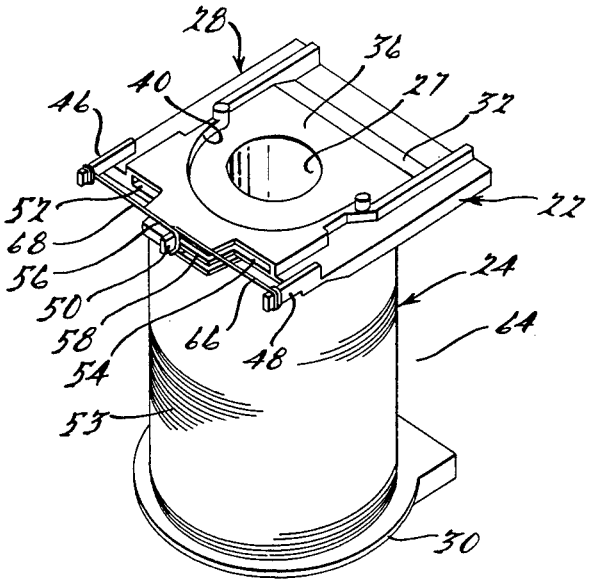
FIG. 6.
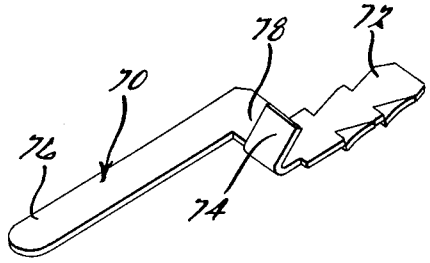
FIG. 7.
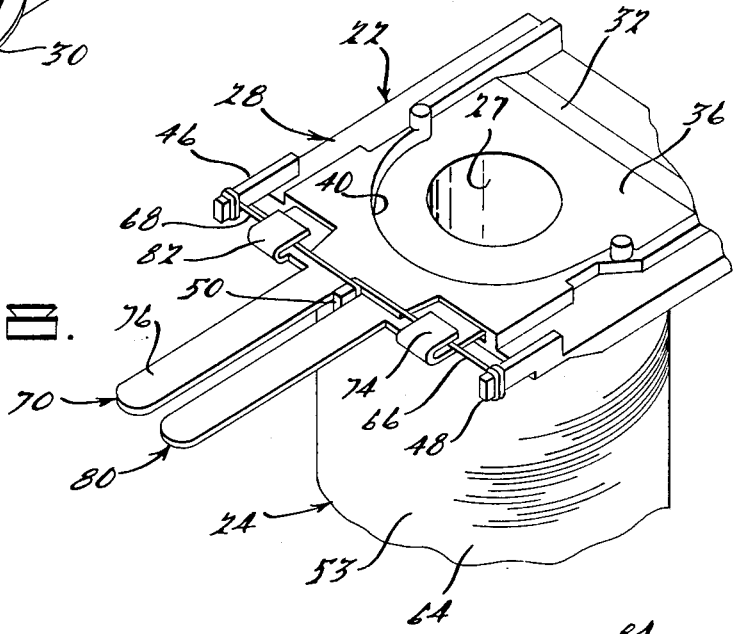
FIG. 8.
FIG. 9.
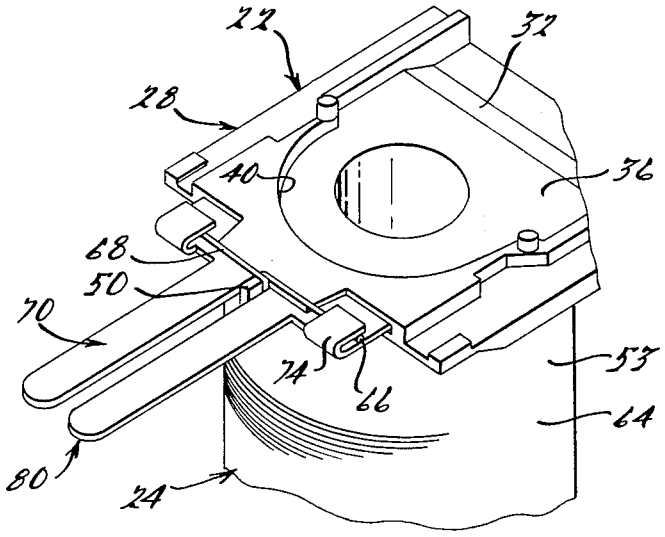
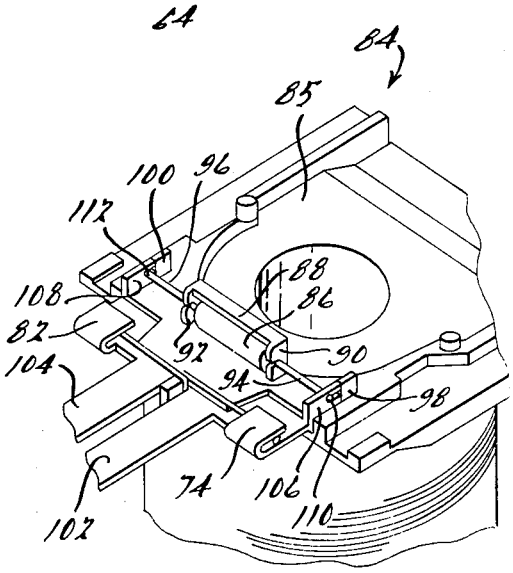
FIG. 10.

SOLENOID OPERATED FLUID CONTROL VALVE

BACKGROUND OF THE INVENTION

This invention relates to a solenoid operated fluid control valve and particularly to one adapted for use in motor vehicles.

Modern motor vehicles employ complex fluid control system such as the pneumatically operated portions of the vehicle's emission control system. For such systems, it is frequently desirable to employ valves which switch or control the flow of fluid using low voltage electrical signals. Such valves are frequently used to control vacuum signals which are used to operate exhaust gas recirculation (EGR) systems or to control functions of a vehicle's heater, ventilation and air conditioning systems. Numerous designs for such solenoid operated valve devices are presently known. This invention seeks to provide a number of improvements in the design, operation, fabrication and calibration of such valve assemblies.

In solenoid designs using a "C" frame which provides a conduction path for a portion of the closed magnetic circuit of the device, it is ordinarily desirable to position the frame member such that it is in direct contact with the metal pole piece and/or other components of the magnetic circuit. These inventors have, however, found that direct contact between the "C" frame member and pole piece of a solenoid operated valve can cause vibrations to be transmitted to the solenoid structure which results in the emission of high decibel audible sounds during actuation. Such noise can constitute an annoyance to the vehicle occupants particularly if the device is installed in a motor vehicle in close proximity to the occupant compartment. Accordingly, it is an object of this invention to provide a solenoid operated valve device which features low actuation sound levels.

Modern manufacturing techniques rely heavily on automated assembly as a means of reducing piece price. Such efforts toward automation have been particularly evident in the domestic automobile industry. In the past, great difficulty has been encountered in winding coils for solenoid devices using entirely automated processes. Typically, it is necessary to employ manual operations to terminate the ends of the solenoid coil. It is, accordingly, another object of this invention to provide a coil assembly which can be fabricated employing automated machinery.

For solenoid operated fluid control valves to operate in accordance with motor vehicle manufacturer's rigid specifications, it is necessary to provide highly accurate relationships amongst the various components of the device. One approach toward achieving such accuracy is to provide highly precision components having narrow dimensional tolerance ranges. Although devices constructed in such a manner operate satisfactorily, they are costly due to the required dimensional precision of the components. Another approach is to provide a means for calibrating the components such that the article is tolerant to component dimensional variations. If a cost effective calibration process is available, this approach can provide cost savings. It is, accordingly, yet another object of this invention to provide a solenoid operated valve incorporating a method for calibrating the system to precise dimensional relationships without requiring critically dimensioned components.

SUMMARY OF THE INVENTION

A solenoid operated fluid control valve constructed in accordance with this invention provides the above-mentioned desirable features. The device preferably includes a "C" frame member which is positioned in close proximity with the pole piece and armature components, but is isolated from them through an encapsulation process which forms a layer of polymeric encapsulation material between the "C" frame and the associated components of the magnetic circuit. These inventors have found that such a layer of encapsulation material substantially reduces the noise output of the device during actuation as compared with similar devices wherein such direct contact is present. Furthermore, by completely surrounding the "C" frame member with encapsulation material, an additional advantage is realized. Exposed metal parts in the motor vehicle environment must ordinarily be plated or otherwise treated to enable them to withstand the highly corrosive and severe environmental conditions which they are subjected to. By complete encapsulation of the "C[ frame member, the necessity for such corrosion protection measures is eliminated since the article is not subjected directly to such environments, and accordingly, cost savings are realized.

The costs associated with fabricating a solenoid operated fluid valve assembly in accordance with this invention are additionally reduced through employing a coil bobbin design which enables the coil assembly to be fabricated using automated machinery. This feature is achieved by providing a bobbin having terminal receiving cavities which are oriented in a specific manner with respect to separated coil winding posts. At the beginning of the winding operation, the start end of the wire is wound around one of the upstanding posts formed integrally with the bobbin structure and is then wrapped onto the bobbin center tube. The finish end of the coil wire is wrapped around another upstanding post formed integrally with the bobbin structure. Terminal members are inserted within the terminal receiving cavities and include portions for capturing the coil wire. Following the step of mechanically and electrically welding the wire to the terminal members, the wire wrapping posts may be severed from the assembly. This configuration permits automated winding since the coil wire is fully supported and positioned without free ends which complicate automated handling.

Calibration of the solenoid operated valve assembly in accordance with this invention includes providing a subassembly incorporating the various fluid control valve elements in their installed position and driving a pole piece member into the coil assembly bore as a predetermined current is applied to the solenoid coil. Once a change in state of the valve element is observed, the motion of the pole piece is arrested and the device is properly calibrated. The pole piece is designed to closely fit within the coil assembly bore so that it will remain in the desired calibrated position. Following the calibration step, the remaining components of the assembly may be installed and the fabrication of the device is then complete.

Additional benefits and advantages of the present invention will become apparent to those skilled in the art to which this invention relates from the subsequent description of the preferred embodiments and the appended claims, taken in conjunction with the accompanying drawings.

BRIEF DESCRIPTION OF THE DRAWINGS

FIG. 6 is a pictorial view of the coil bobbin shown in FIG. 2 having the wire coil wound thereon;

FIG. 7 is a pictorial view of a terminal particularly adapted for use with the bobbin according to this invention;

FIG. 8 is a pictorial view of one portion of the coil assembly showing particularly the engagement of the terminals with the start and finish wire ends of the coil;

FIG. 9 is an enlarged partially broken away pictorial view of the coil assembly showing the wire winding posts of the coil bobbin removed;

FIG. 10 shows an alternate embodiment of a coil bobbin and terminals according to this invention which includes provision for mounting a diode;

DETAILED DESCRIPTION OF THE INVENTION

Figure 1:
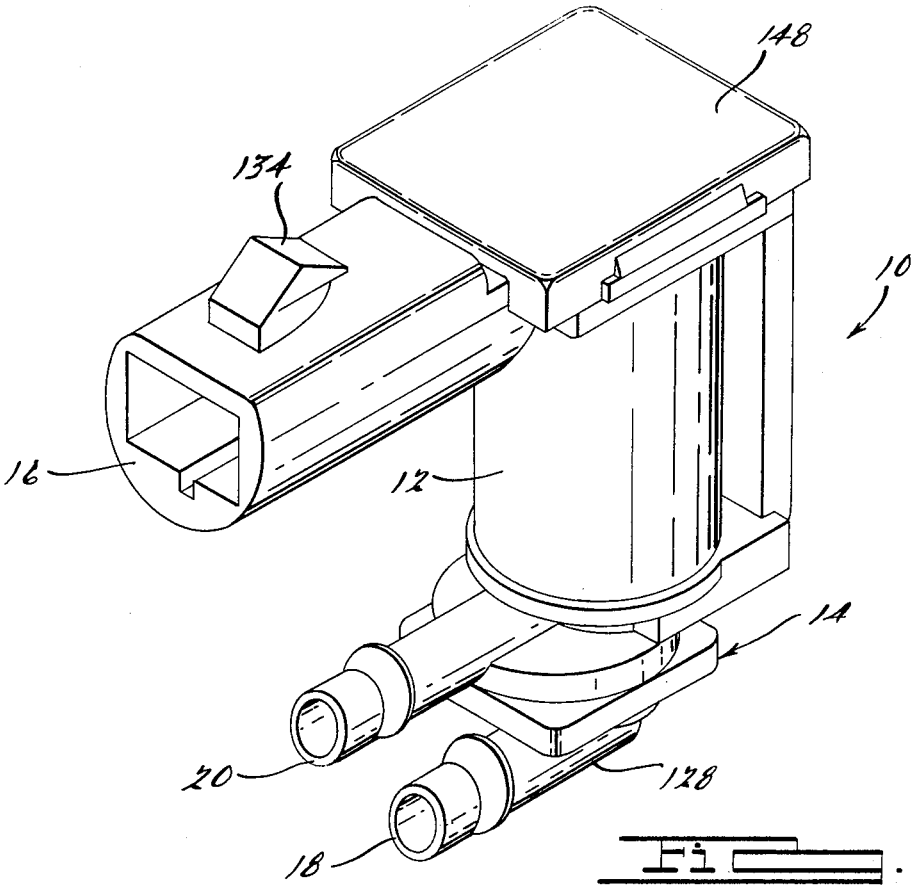
FIG. 1 is a pictorial view of a solenoid operated fluid control valve in accordance with this invention.

A solenoid operated fluid control valve assembly is shown in FIG. 1 completely assembled and is generally designated by reference number 10. As shown in FIG. 1, the valve assembly 10 includes a cylindrical coil assembly portion 12 with a valve assembly portion 14 at one end thereof and an electrical terminal receiving socket 16 at the opposite end thereof. The valve assembly portion 14 defines a vacuum signal port 18 and a control port 20. The valve assembly 18 is adapted to communicate the vacuum signal present at the port 18 to the control port 20 when an appropriate electrical control signal is provided. The valve assembly 10 is particularly adapted to be used in the motor vehicle environment for switching vacuum signals to various components associated with the vehicle, such as emission control systems, and heating, ventilation, and air conditioning systems.

FIGS. 2 through 5 provide detailed views of the coil bobbin 22 which is employed in forming the coil assembly 24 shown in FIG. 6. As previously mentioned, various improvements in design of the coil assembly 24 are provided which enable that structure to be fabricated through automated techniques. The coil bobbin 22 includes an elongated hollow center tube 26 having radially extending end flanges 28 and 30. The flanges 28 and 30 each define ramped surfaces 32 and 34 which transitions to end surfaces 36 and 38. The end surfaces 36 and 38 are bounded by upstanding circular walls 40 and 42. The ramped surfaces 32 and 34, the end surfaces 36 and 38, and the wall portions 40 and 42 cooperate to receive a "C" frame member 44 which is described in greater detail below. The end portion 28 further defines a pair of radially extending wire wrapping posts 46 and 48 which extend along opposite edges of the end portion 28, with the center wire wrapping posts 50 positioned therebetween. The end portion 28 further defines several cavities which are provided to receive electrical terminals. Adjacent both of the end posts 46 and 48 are cavities or sockets 52 and 54 which form enclosed pockets within the end portion that extend into the end portion in a radial direction with respect to the center tube 26. The pockets 56 and 58 are formed adjacent the post 50 and are not as deep as the pockets 52 and 54. The end portion 28 further defines a pocket 60 which is bounded on one side by the extending plate portion 62. The pocket 60 defines a "V" shaped aperture within the portion of the end portion 28 facing the center tube 26.

The coil bobbin 22 is particularly adapted for automated winding techniques since the posts 46, 48, and 50 provide means for attaching and positioning the start end 66 of the coil wire 53 for the winding operation and for anchoring the finish end 68 so as to hold the winding tightly on the bobbin. In practice, the wire 53 may be attached initially to either of the wrapping posts 46 or 48; however, for the purpose of illustration, the start end 66 of the wire is shown in FIG. 6 wrapped around the post 48. From there, the wire is extended to and wrapped around the center post 50, as also shown in FIG. 6, and then led through the pocket or slot 60. It will be observed that the slot 60 opens laterally in the direction of the bobbin center tube 26 so that the wire extending from the slot is positioned to be wrapped around the center tube in multiple layers. Thus, the slot 60 guides the initial length of wire that extends from the binding post 48 to the surface of the center tube 26 and protects it from abrasion during the winding operation. In practice, this is important since anything that interferes with the wire during winding abrades and can even strip away the insulation layer from the wire. After the desired number of turns have been wound onto the center tube 26, the wire is again wrapped around the center binding post 50 and then extended to and wrapped repeatedly around the other binding post 46.

FIG. 6 shows the coil bobbin 22 after the completion of the coil wire wrapping procedure. An electrical terminal particularly adapted for use in conjunction with the coil bobbin 22 is shown in FIG. 7. The terminal 80 includes a barbed mounting portion 72 and a reversely bent extending flange defining a terminal contact 74. The extending terminal blade 76 is joined to the remainder of the terminal by the lateral portion 78.

During the assembly process of the coil assembly 24, the terminal 80 is loaded onto the bobbin 22 such that the barbed mounting portion 72 is inserted within the cavity 54. The barbs of the portion 72 prevent the terminal 80 from becoming detached from the bobbin. When the terminal 80 is fully inserted, the laterally projecting portion 78 is supported by the cavity 58 and the terminal contact 74 captures the coil start end 66. In order to provide such capturing, it is necessary to position the start and finish ends 66 and 68 such that they extend adjacent the pockets 52 and 54 but are offset therefrom so that they do not intersect an outward extension of the surfaces defined by the pockets. If such intersecting occurred, there would be interference between the mounting portion 72 and the coil wire. Another terminal member 70 which is a mirror image replication of the terminal 80 is inserted into the cavity 52 and has a terminal contact portion 82 adapted to capture the coil finish end 68. Once the terminals 70 and 80 are loaded, the terminal contact portions 74 and 82 are deflected to clampingly engage the wire. Thereafter, or simultaneous with such deflection, welding or soldering, or other termination techniques may be employed to provide a secure mechanical and electrical connection. Once such termination process is completed, the posts 46 and 48 no longer serve a useful function and may consequently be removed as shown in FIG. 9.

FIG. 10 illustrates an alternate embodiment of a coil assembly indentified by reference number 84. The coil assembly 84 differs from the coil assembly 24 in that the bobbin end portion 85 further defines a diode receiving pocket 88 having end walls 90 and 92 which are notched to provide clearance for connection of wires 94 and 96 of diode 86. In many applications, it is desirable to provide a diode 86 as a means of inhibiting voltage spikes from being transmitted to the vehicle's battery power lines. The end portion 85 additionally includes upstanding posts 98 and 100. The terminals 102 and 104 include plate portions 106 and 108 which define wire receiving notches 110 and 112. The terminals 102 and 104 are inserted onto the coil assembly 84 and engage the associated start and finish ends of the coil assembly. In addition, the notches 110 and 112 of the terminals engage connecting wires 94 and 96 of the diode 86, thus making electrical contact therewith. The posts 98 and 100 position and support the connecting wires to enable the wires to be inserted within the notches 110 and 112 as the terminals 102 and 104 are loaded in position.

Figure 11:
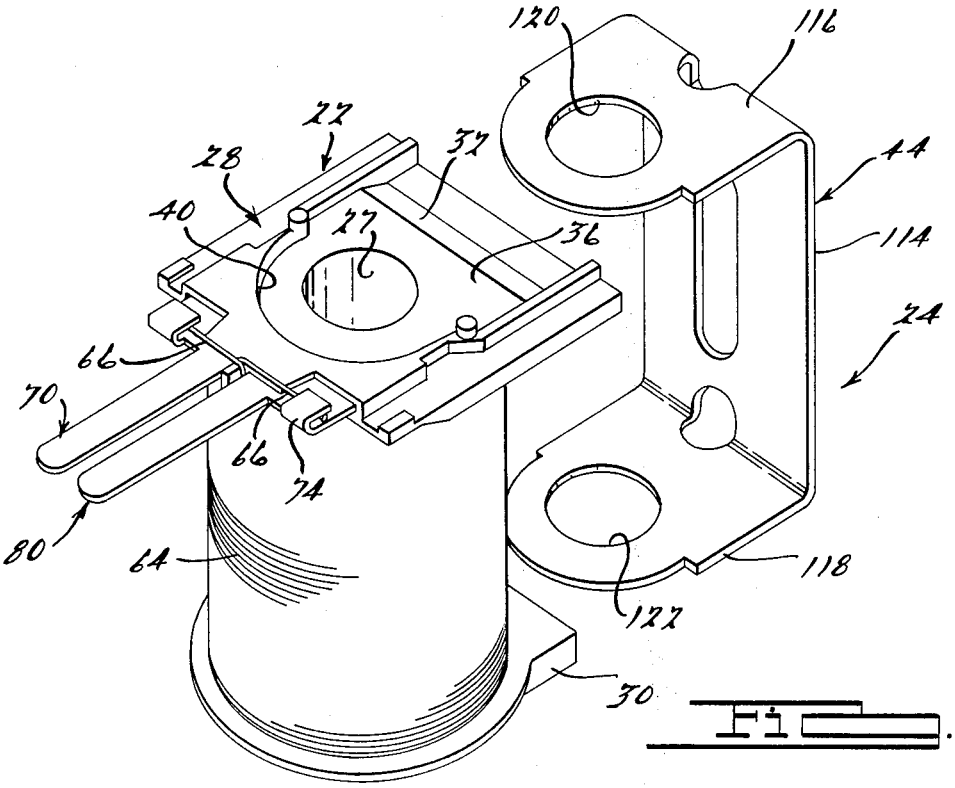
FIG. 11 is a pictorial view showing the "C" frame member being mounted onto the completed coil assembly.
Figure 2:
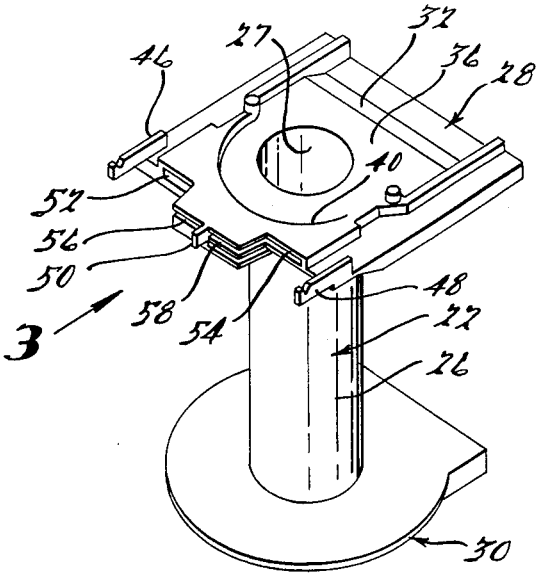
FIG. 2 is a pictorial view of the coil bobbin component employed for the valve shown in FIG. 1.
Figure 3:
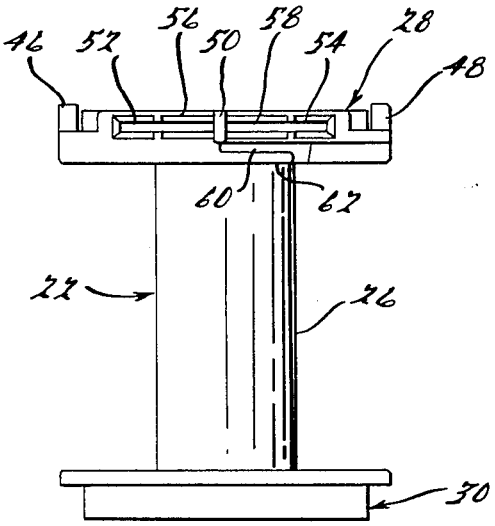
FIG. 3 is a frontal view of the coil bobbin shown in FIG. 2 in the direction of Arrow 3.
Figure 4:
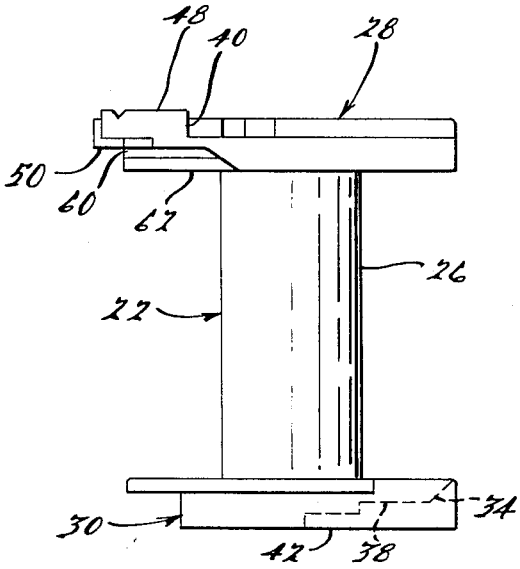
FIG. 4 is a side view of the coil bobbin shown in FIG. 2.
Figure 5:
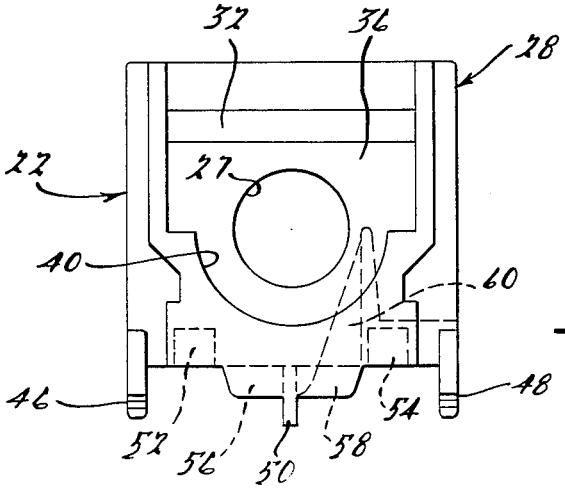
FIG. 5 is a top view of the coil bobbin shown in FIG. 2.

FIG. 11 shows the "C" frame member 44 in position for installation onto the coil assembly 24. The "C" frame 44 defines a middle plate portion 114 with a pair of end flanges 116 and 118, defining circular holes 120 and 122, respectively. During assembly, the "C" frame 44 is installed onto the coil assembly 24 by sliding the bracket such that the ends 116 and 118 engage the ramped surfaces 32 and 34. In the assembled position, the "C" frame 44 is located with respect to the coil assembly 24 such that the holes 120 and 122 are concentric with the bore 27 of the center tube 26 and have a slightly larger diameter.

Figure 12:
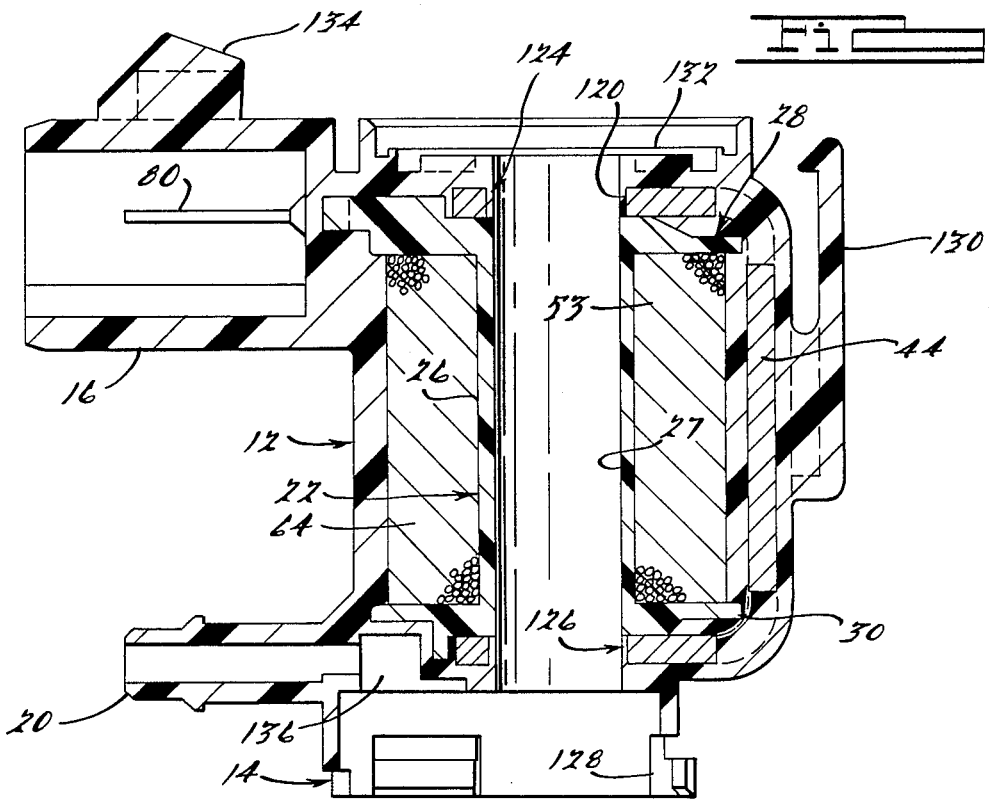
FIG. 12 is a cross-sectional view of the subassembly of a valve according to this invention following the encapsulation process.

During the fabrication process of the valve assembly 10, the subassembly shown in FIG. 11 including the "C" frame 44 is inserted into an injection molding cavity. Polymeric resin material is injected into the molding cavity to encapsulate the exterior surfaces of the coil assembly 24 and the "C" frame 44. Since encapsulation of the bracket 44 encloses its outer surfaces, the bracket is fully protected from the environment, and therefore, costly surface treatment and/or plating processes are avoided. In accordance with a significant feature of this invention, the encapsulation process produces annular bands of encapsulation material in the region bounded by the inside of the holes 120 and 122 of the bracket 44, and an imaginary cylinder passing through the bore 27 of the center tube 26. The inside diameter of the bands are formed by portions of the die cavity (not shown). These annular bands are best shown in FIG. 12 and are designated by reference numbers 124 and 126. The encapsulation material further defines a number of additional physical features of the valve assembly 10 including an electrical terminal receiving socket 16, a valve body 128, a control port 20, a hanger clip 130, and a vent housing 132. The hanger clip 130 permits the valve assembly 10 to be attached to any convenient structure of a motor vehicle such as an engine bracket, the dash or fender, etc. The inside cavity portion of the electrical terminal receiving socket 16 is configured to correspond to the shape of an attaching electrical connector (not shown). In conventional motor vehicle design practices, such connectors are of an interlocking variety, and accordingly, an interlocking tab 134 is provided. The valve body 128 defines an open cavity 136 which communicates with the port 20.

Figure 13:
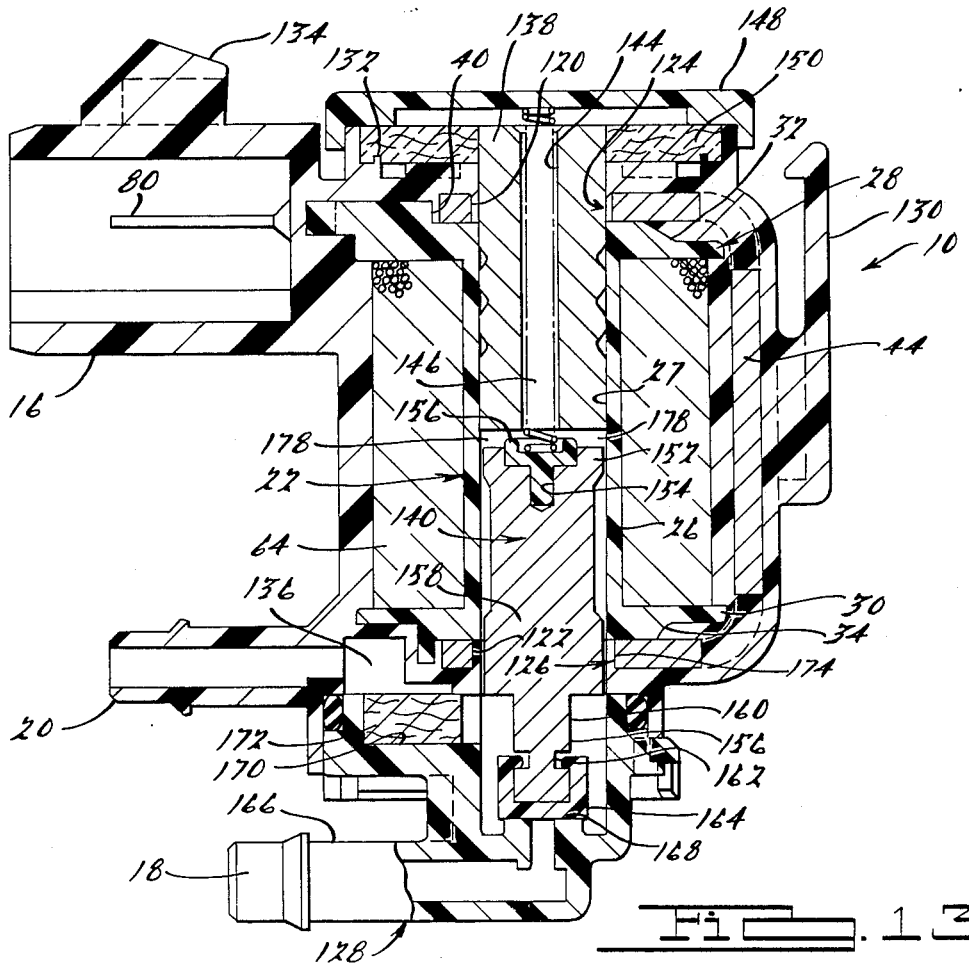
FIG. 13 is a cross-sectional view showing the valve assembly according to this invention completely assembled.
Figure 14:
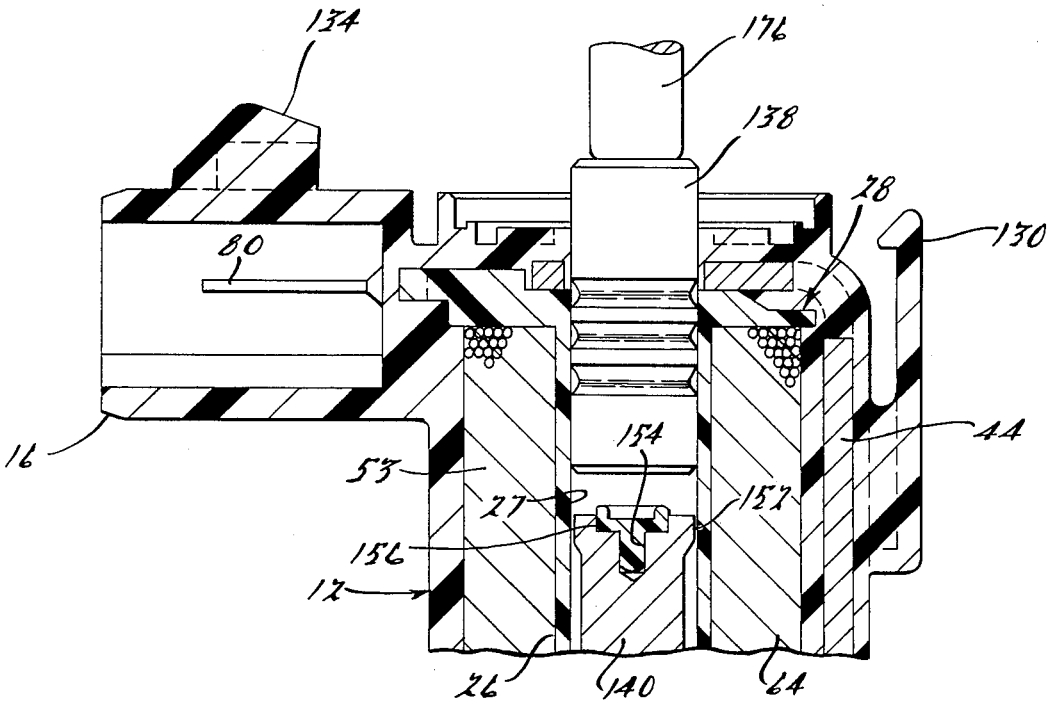
FIG. 14 is a partial cross-sectional view of a coil assembly according to this invention showing the calibration step.

FIG. 13 shows the valve assembly 10 completely assembled. The magnetic circuit of the valve assembly 10 includes a pole piece 138 and an armature 140. The pole piece 138 is a cylindrical member adapted to be inserted within the bore 27 and is dimensioned to provide an interference fit therewith so that it can be permanently installed in a desired longitudinal position in the bobbin 22. Annular ridges 142 are provided within the outer surface of the pole piece 138 to enhance its frictional engagement with the bore 27. The pole piece 138 defines an elongated longitudinal bore 144 which receives a spring 146. Filter cover 148 encloses the end of the valve assembly 10 adjacent the pole piece 138. As will be better explained below, during operation of the valve 10, air is permitted to flow around the filter cover 148, and pass through the bore 144, around the armature 140, and finally out of the control port 20. A vent filter 150 is provided beneath the filter cover 148 to remove undesirable particulates from the air flowing as described above. The armature 140 is mounted for longitudinal reciprocable movement within the bore 27. The armature 140 includes a vent valve end 152 having a blind bore 154 which receives a vent valve 156. The vent valve 156 is adapted to provide a fluid seal surrounding the bore 144 when it engages the adjacent end of the pole piece 138 when the armature 140 is moved to the upper limit of its travel in response to coil energization, thereby sealing that bore from fluid surrounding the armature. The opposite end of the armature 140 defines a valve end 158 having a projecting pin 160 with an annular groove 162. The valve member 164 is mounted on a pin 160 and engages a groove 162.

The valve cover 166 is installed within the cavity 136 and defines a circular port 168 which communicates fluidically with the vacuum signal port 18. The valve cover 166 further defines a chamber 170 adapted to receive a sponge filter element 172. When the armature 140 is in the position shown in FIG. 13, the vacuum signal applied to the port 18 cannot communicate with the control port 20 due to the sealing engagement between the valve member 164 and the port 168. In this position, however, as mentioned above, communication is provided between the control port 20 and the atmosphere through the filter cover 148. A spring 146 is provided to maintain the armature 140 in this normal position.

When electrical current is passed through the coil 64 by a voltage signal applied to the terminals 70 and 80, the armature 140 is attracted to the pole piece 138 due to their opposite polarity created by the completed magnetic circuit which also includes the coil 64 and the "C" frame 44. Magnetic fields are transferred to the armature 140 through the air gap 174 between the bore 122 of the "C" frame 40 and the armature 140. The attracting force which causes the armature 140 to translate within the bore 27 is provided by the air gap 178 between the pole piece 138 and the armature 140. As previously mentioned, one aspect of this invention is the provision of annular ring of material 124 which separates "C" frame 44 from the remaining components of the magnetic circuit. Such gaps of non-magnetic material constitute losses in the magnetic circuit and are ordinarily avoided for this reason. However, these inventors have found that the presence of the ring 124 significantly reduces the noise output caused by actuation of valve assembly 10 while constituting only a minor essentially insignificant degradation in performance provided that these gaps are kept to small dimension limits. Prototype devices have been employed having gap distances of approximately 0.020 inch. This gap distance was selected to be large enough to insure that encapsulation material will flow into the region of the rings 124 and 126, yet not so large as to constitute significant degradation in performance of the valve 10. A reduction in noise output results since the presence of the resin material provides mechanical isolation of the components in a manner that causes attenuation of vibrations generated during valve cycling. Such attenuation is particularly desirable when the valve 10 is mounted on a motor vehicle dash panel, fender, or other location which provides a sound transmission path to the occupant compartment. The band 126 is provided to prevent direct contact between the frame 44 and the armature 140 which would interfere with free movement of the armature.

When the armature 140 is attracted toward the pole piece 138, the valve element 164 is pulled away from the orifice 168 and the vent valve 156 seals against the bore 154. In this state, the valve 10 provides fluid communication between the vacuum signal port 18 and the control port 20. The filter element 172 removes particulates larger than a given size within the transferred fluid to prevent contamination of associated fluid control components.

During the assembly process of the valve assembly 10, it is necessary to carefully control the physical parameters of the valve in order to provide acceptable operational characteristics. In the de-energized position shown in FIG. 13, the spring 146 provides a biasing force which urges the valve 164 into sealing engagement with the port 168. In this condition, an air gap 178 of a preselected dimension is created In this condition, an air gap 178 of a preselected dimension is created between the armature 140 and the pole piece 138. It is important to carefully control the distance of this air gap since the magnetic force generated across an air gap varies exponentially with the distance. One means of precisely controlling the air gap 178 is to provide components of highly precisioned dimensional characteristics. This approach, however, has the disadvantage of increased cost of the components. In accordance with this invention, a calibration procedure is carried out which produces a desired air gap distance. The calibration procedure begins by mounting the valve assembly 10 in a fixture in a condition prior to its final assembly. All the components of the valve assembly 10 are present with the exception of the pole piece 138 and the filter cover 148. A vacuum or pressure signal is provided to the port 18 (or 20), and that pressure is monitored. A voltage signal is applied to the coil to produce a desired amperage. For example, a voltage of about 7.4 volts may be applied as a test signal. This test signal was selected since it is below the lowest test voltage provided by the 12-volt electrical systems of modern motor vehicles. Operation at such a test voltage level insures that the valve 10 will operate satisfactorily in field conditions when battery voltage falls to the lower end of the normal range which is generally assumed to be about 8.5 volts. A test level of lower than the expected minimum battery voltage is also desirable to ensure proper operation in conditions wherein the coil 64 becomes hot, which causes coil resistance to increase. The pole piece member 138 with the spring 146 are located within the bore 27 and a tool 176 acts on the pole piece to drive it downwardly toward the armature. The tool 176 is driven through a drive system which may incorporate a gear motor or another type of precision linear drive. The pole piece 138 is driven downwardly until the air gap between it and the armature 140 decreases to the point that the magnetic forces acting across the air gap 178 overcome the combined forces of the tension of the spring 146 and the forces created due to pressure in port 168 acting on valve 164, such that the armature lifts toward the pole piece. Once this change in state occurs, a change in pressure in control port is detected and the mechanism driving the pole piece 138 is caused to stop movement. In this configuration, the valve assembly 10 is properly calibrated since it can be cycled through the application of the chosen test signal. Thereafter, the valve assembly is removed from the calibration fixture, and the vent filter 150 and the filter cover 148 are installed, thus completing assembly of the device. In the embodiment of the valve 10 described herein, the spring 146 is not compressed after assembly to the same extent as during calibration, since the filter cover 148 permits the spring to extend above the upper surface of the pole piece 38. This difference between the condition of the valve 10 during calibration and use may be deemed insignificant or may be compensated for by selection of the test voltage or the applied pressure signal.

While the above description constitutes the preferred embodiments of the present invention it will be appreciated that the invention is susceptible to modification, variation and change without departing from the proper scope and fair meaning of the accompanying claims.

What is claimed is:

1. A solenoid assembly comprising:

coil means defining an internal bore, a frame member having a middle portion and a first flange extending transversely from said middle portion, said first flange defining a first aperture, a pole piece disposed and fixed in said coil means bore and within said first frame member aperture such that a first clearance is provided between said pole piece and said first flange portion such that said pole piece and said frame member do not contact each other, an armature member disposed in said coil means bore and movable in said bore in response to energization of said coil means, and a first ring of polymeric resin material within said first clearance thereby preventing direct contact between said frame and said pole piece.

2. A solenoid assembly according to claim 1 wherein said first ring of polymeric resin material is formed by encapsulating said coil means and said frame member with said resin material.

3. A solenoid assembly according to claim 1 wherein said first aperture is circular in shape and said pole piece is cylindrical in shape whereby said first ring is annular in shape.

4. A solenoid assembly according to claim 2 wherein said ring of polymeric resin material has a thickness which is slightly greater than the minimum thickness necessary to cause said resin material to form said ring.

5. A solenoid assembly according to claim 1 wherein said frame member further defines a second flange extending transversely from said middle portion and spaced from said first flange, said second flange defining a second aperture and wherein said armature is further disposed to move within said second flange and defining a second radial clearance and wherein a second ring of polymeric resin material is disposed within said second radial clearance.

6. A solenoid assembly according to claim 5 wherein said second aperture is circular in shape and said armature is cylindrical in shape whereby said second ring is annular in shape.

7. A solenoid assembly, comprising:

coil means defining an internal bore bounded by a pair of axial ends, a frame member having a middle portion and first and second end flanges extending transversely from said middle portion, said end flanges defining respectively first and second apertures, said frame member disposed relative to said coil means such that said end flanges surround said axial ends of said internal bore, a pole piece disposed and fixed in said coil means bore and within said first aperture thereby defining a first clearance between said pole piece and said first end flange such that said pole piece and said frame member do not contact each other, an armature member disposed in said coil means bore and movable in said bore in response to energization of said coil means, said armature further disposed in said second aperture thereby defining a second radial clearance between said armature and second end flange, and first and second rings of polymeric resin material within said first and second radial clearances thereby preventing direct contact of said frame member with said pole piece and said armature.

8. A solenoid assembly according to claim 7 wherein said first and second rings of polymeric resin material are formed by encapsulating said coil means and said frame member with said resin material.

9. A solenoid assembly according to claim 8 wherein said ring of polymeric resin material has a radial thickness which is slightly greater than the minimum thickness necessary to cause said resin material to form said ring.

10. A solenoid assembly according to claim 7 wherein said first and second apertures are circular in shape and said pole piece and said armature are cylindrical in shape whereby said rings are annular in shape.

11. In a solenoid valve adapted primarily for automotive use and having improved vibrational noise characteristics, the solenoid portion of which comprises a bobbin, pole piece and armature members carried by and projecting from opposite ends of said bobbin, and a "C" frame having end flanges embracing the ends of said bobbin, the improvement comprising:

means defining openings in said end flanges through which said pole piece and said armature members extend, said openings defining edge surfaces spaced respectively from direct contact with said pole piece and said armature members, encapsulating layers of a polymeric resin insulating and vibration damping material on at least the end flanges of said "C" frame, and portions of said layers overlying the edge surfaces of said openings and being interposed between said edge surfaces and the portions of said pole piece and armature members disposed in said openings, whereby dampening vibrations transmitted in use between said "C" frame and said solenoid and inhibiting noise resulting from said vibrations.

12. A solenoid valve according to claim 11, wherein the overlying portion of one of said encapsulating layers is in physical contact with said pole piece as well as the edge surface of the opening through which said pole piece extends.

13. A solenoid valve according to claim 11, wherein the overlying portion of one of said encapsulating layers is in physical contact with said pole piece, and wherein the overlying portion of the other of said encapsulating layers is spaced radially outwardly from said armature.

14. A solenoid valve according to claim 11, wherein said encapsulating layers are integral portions of a body of said vibration and damping material that encapsulates all of said "C" frame and adjacent surfaces of said solenoid portion.

15. A coil assembly for a solenoid device, comprising:

a bobbin having a center tube portion and a radially projecting flange portion, said flange portion defining first and second wire wrapping posts, and first and second terminal receiving cavities adjacent said posts.

coil wire wrapping on said bobbin such that a start end of said wire is wrapped on said first post and around said bobbin center tube and a finish end of said wire is wrapped on said second post such that said wire start and finish ends pass adjacent said cavities and sections of said wire are positioned laterally offset from said cavities, and first and second terminal members having a mounting portion adapted to be received by said terminal receiving cavities, a wire engaging portion distinct from said mounting portion adapted to capture said start or finish end of said wire as said mounting portion is inserted in said cavities said wire engaging portion defined by a reversely bent tab which captures said wire and is adapted to be clamped against a portion of said terminal to secure said wire, said terminal members further having a terminal blade portion.

16. A coil assembly for a solenoid device according to claim 15 wherein said bobbin further defines terminal supporting cavities adjacent said terminal receiving cavities and wherein said terminal defines an offset portion configured to be received by said terminal supporting cavities.

17. A coil assembly for a solenoid device according to claim 15 wherein said bobbin further defines a center wire wrapping post positioned between said first and second wire wrapping posts.

18. A coil assembly for a solenoid device, comprising:

a bobbin having a center tube portion and first and second radially extending end flange portions at opposing ends of said center tube, said first end flange portion defining first and second wire wrapping posts with first and second terminal receiving cavities adjacent and between said wire wrapping posts and a center post between said terminal receiving cavities, a coil of wire wrapped on said bobbin such that a start end of said wire is wrapped on said first post, around said center post and around said bobbin, and a finish end of said wire is wrapped around said center post and said second wire wrapping post such that said start and finish ends pass adjacent said cavities and sections of said wire are laterally offset from said cavities, and first and second terminal members having a mounting portion adapted to be received by said terminal receiving cavities, a wire engaging portion distinct from said mounting portion defined by a reversely bent tab adapted to capture said start or finish ends of said wire as said mounting portion is inserted into said cavities, and a terminal blade portion.

19. A coil assembly for a solenoid device according to claim 18 wherein said bobbin further defines terminal supporting cavities adjacent said terminal receiving cavities and wherein said terminals define an offset portion configured to be received by said terminal supporting cavities.

20. A solenoid coil including a bobbin having an end flange and wherein said coil has start and finish end portions adjacent to said end flange, the improvement comprising:

laterally spaced cavities in said end flange, and binding posts on said flange disposed intermediate and outboard of said cavities, said outboard binding posts being breakable from said flange, electrical terminal members having rearwardly extending, longitudinal mounting portions and wire clamping tabs disposing forwardly of said mounting portions, the mounting portions of said terminals adapted to be inserted into and to be retained by said cavities, the start and finish end portions of said coil wire adapted to be wrapped initially around and extended between said intermediate and outboard binding posts, said tabs being disposed to overlay the extended portions of said coil wire when the mounting portions of said terminals are pushed into said cavities and adapted further to be bent into clamping relationship with and welded to said extended wire portions and underlying portions of said terminal members, and said extended wire portions adapted to be snapped off at said tabs when said outboard binding posts are broken away from said flange.

21. A method of calibrating a solenoid operated valve of the type having a coil assembly defining an internal bore, a pole piece adapted to be inserted into said bore and in frictional engagement therewith, and an armature mounted for axial movement with said bore and relative to said pole piece coupled to a valve assembly having a valve element which controls fluid flow through a port, and spring means urging said armature away from said pole piece, comprising the steps of:

providing a subassembly of said solenoid operated valve including said coil assembly, said armature and said valve assembly, supplying a fluid pressure signal to said port, applying a voltage signal to said coil assembly, loading said pole piece into said coil assembly bore, driving said pole piece into said bore, monitoring said fluid pressure signal, and stopping said driving when a change in state of said valve assembly occurs as determined by said fluid pressure signal, whereby the desired calibrated relationship betwen said pole piece and said armature is provided.

22. A method of calibrating a solenoid operated valve according to claim 21 wherein said solenoid operated valve is particularly adapted by use in a motor vehicle and wherein said step of applying said voltage signal comprises applying a voltage of a valve less than the lowest voltage within the normal operating range of the battery supply of said motor vehicle.

23. A method of calibrating a solenoid operated valve according to claim 22 wherein said voltage signal is 7.4 volts.

* * * * *